United States Patent [19]

Bennett et al.

[11] 4,193,057

[45] Mar. 11, 1980

[54] AUTOMATIC DEPLOYMENT OF HORIZONTAL LINEAR SENSOR ARRAY

[75] Inventors: Derek J. Bennett; Daniel J. Hogan, both of Thousand Oaks, Calif.

[73] Assignee: Bunker Ramo Corporation, Oak Brook, Ill.

[21] Appl. No.: 888,165

[22] Filed: Mar. 20, 1978

[51] Int. Cl.[2] ..... H04R 1/46

[52] U.S. Cl. ..... 367/153; 9/8 R; 367/4

[58] Field of Search ..... 340/2, 5 R, 7 PC, 8 S; 9/8 R

[56] References Cited

U.S. PATENT DOCUMENTS

| | | | |
|---|---|---|---|
| 3,230,500 | 1/1966 | Dunn | 340/5 R |
| 4,004,265 | 1/1977 | Woodruff et al. | 340/2 |
| 4,048,686 | 9/1977 | Ege | 9/8 R |
| 4,121,529 | 10/1978 | Smith et al. | 9/8 R X |

*Primary Examiner*—Richard A. Farley

*Attorney, Agent, or Firm*—F. M. Arbuckle; W. Lohff; A. Freilich

[57] ABSTRACT

A linear sensor array is deployed horizontally on the ocean floor by first deploying a vertical array, between an anchor and a float from which the array is suspended, and then decreasing the buoyancy of the float gradually as the float is carried away from the anchor by ocean currents. The float is comprised of a suitably large volume of buoyant material such as hollow glass microspheres freely floating inside a liquid filled plastic container. To gradually reduce buoyancy, the microspheres are allowed to flow out through a neck near the top of the container while water is allowed to enter the bottom of the container through a liquid permeable membrane. The diameter of the neck is selected for optimum sinking rate of the float.

18 Claims, 7 Drawing Figures

10
12
13
13a
14
15
16
17
18
20
21
22
23
24
30
31
32
33
34
35

AUTOMATIC DEPLOYMENT OF HORIZONTAL LINEAR SENSOR ARRAY

BACKGROUND OF THE INVENTION

This invention relates to a method and apparatus for deploying a linear array of sensors (e.g., hydrophones) in a horizontal orientation on the ocean floor.

It has been previously proposed to deploy a linear array of sensors in a vertical orientation above the ocean floor using a buoyant body to suspend the array of sensors between the buoyant body and an anchor, and using the signal cable of the sensors as a tether for the buoyant body. The sensors are connected to the cable at spaced intervals. The buoyant body could be constructed of a syntactic foam comprised of hollow glass microspheres in a plastic matrix.

In sonar sensor technology, it is often desirable to form a horizontal linear array of hydrophones to obtain long-range detection of targets. Horizontal arrays are particularly suited to regions on or near the continental slope where they may be laid along the bottom. Very large arrays of this type are deployed by cable from ships. It is desirable to also deploy much smaller arrays that would be dropped by aircraft, small ships or submarines, and it is sometimes desireable to deploy a horizontal linear array. Accordingly, an object of this invention is to provide a method and apparatus for deploying a horizontal linear array of sensors.

SUMMARY OF THE INVENTION

In a preferred embodiment, a vertical linear array is deployed using a suitable anchoring body and a buoyant body so modified that it will gradually lose its buoyancy. In that manner the array may sink gradually while the buoyant body is carried away from a position over the anchoring body by any slight ocean current present near the ocean floor. The buoyant body is preferably comprised of a suitably large volume of buoyant material (liquid, such as gasoline, or a large number of buoyant particles, such as glass microspheres) freely floating inside a light plastic container tethered to the anchoring body. The top of the container is shaped to have an inverted funnel leading to a narrow neck with a small escape passage for the buoyant materials to flow out. The bottom of the container is sealed with a permeable membrane, or is provided with one or more small holes, thereby to allow a flow of water into the container. The diameter of the escape passage can be selected to produce an optimum time for sinking to the ocean floor, thereby to assure a linear horizontal array in the presence of very low currents. A sealing cap over the escape passage may be provided in order to prevent buoyant material from flowing out whenever a vertical array is desired. If both would be required, but not at the same time, the sealing cap may be made of a material that slowly dissolves in water over a predetermined period. Another alternative is to employ a vane valve operated by ocean currents to open the escape passage only when there is sufficient horizontal current to operate the vane valve, thus assuring that there will be a current present while the buoyant body sinks in order that the horizontal deployment be linear. This alternative could, of course, be used even though the array is not expected to operate for any period in the vertical position.

The novel features that are considered characteristic of this invention are set forth with particularity in the appended claims. The invention will best be understood from the following description when read in connection with the accompanying drawings.

BRIEF DESCRIPTION OF THE DRAWINGS

FIGS. 5 a–c illustrate the manner in which current operated vane valve is employed to seal a float container of a vertical array until a current is present to effect a linear horizontal array.

DESCRIPTION OF PREFERRED EMBODIMENTS

Figure 1:
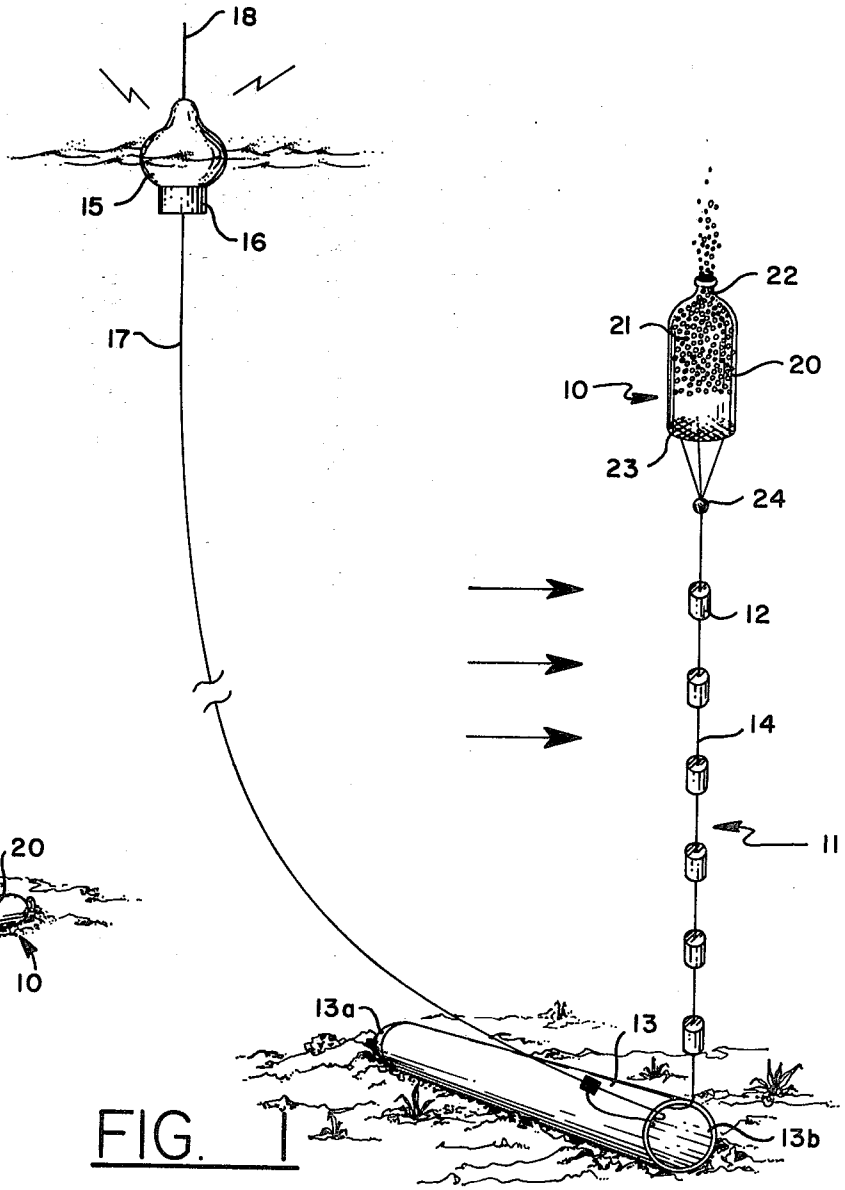
FIG. 1 illustrates a first embodiment of the invention being employed to deploy a linear horizontal array on the ocean floor.

Referring now to the drawings, FIG. 1 illustrates a float 10 and an array 11 of hydrophones 12 deployed from a a canister 13 that is dropped from an aircraft or small ship, or ejected from a submarine. The canister itself serves as a weight to anchor the array of hydrophones connected to the canister by a signal cable 14. Also connected to the canister is an inflatable buoy 15 equipped with an electronic package 16 to receive signals from the hydrophone array over a cable 17. The electronic package includes a transmitter for transmitting radio signals using an antenna 18.

In practice, batteries to power the hydrophone array are stored in the canister 13 near one end closed by a lead ballast 13*a*. An electronic package for the array is stored next to the batteries to add to the ballast at the closed end. Stored next in order from the closed end to an open end 13*b* of the canister is: a pack for the cable 17; a package for the array 11 and an array release mechanism; the array float 10; the surface float 15 and electronic package 16; and in the case of a canister dropped from an aircraft, a parachute or drogue. As described more fully in a copending application Ser. No. 888,019 filed Mar. 20, 1978 titled "System for Deploying a Moored Sensor Array" by Derek J. Bennett, the buoy is deployed from wing racks or bomb bay of the aircraft. The air stream deploys the parachutes which carries the canister to the ocean. Upon impact with the ocean, a seawater battery is activated and fires a pyrotechnic squib which releases gas to inflate the surface buoy 15. As the surface buoy inflates, the parachute releases. The ballasted canister continues to slowly descend to the ocean floor while the cable 17 is payed out through the open end of the canister past the packaged array and array float.

When the lead ballast 13*a* impacts the ocean floor, the array release mechanism is activated and the array float and package is ejected from the canister. At the same time, the cable 17 is locked up as described in a copending application Ser. No. 850,946 filed Nov. 14, 1977, now U.S. Pat. No. 4,143,349, titled "Cable Depth Selector and Coil Shunt Penetrator." Tests have shown that a canister closed at one end with a spherical-shaped ballast can be designed to descend with a glide path of about 60° from the horizontal. Its beneficial effect is that the cable 17 is overdispensed to achieve a required mooring scope which helps insure the mooring's survival. The array float has sufficient buoyancy to erect the array upwardly clear of the cable 17.

The array float 10 is comprised of a plastic container 20 filled with buoyant material, such as a large number of hollow glass microspheres 21 freely floating inside the container 20. The container is preferably bell shaped with a narrow neck 22 through which the microspheres flow out. The bottom of the container is closed, such as by a permeable membrane 23 that allows water to enter the container and displace the buoyant material (microspheres). Attached to the bottom of the container is a weight 24 which aids in causing the container to continue to descend as hydrophones of the array come to rest on the ocean floor in a straight line.

Figure 2:
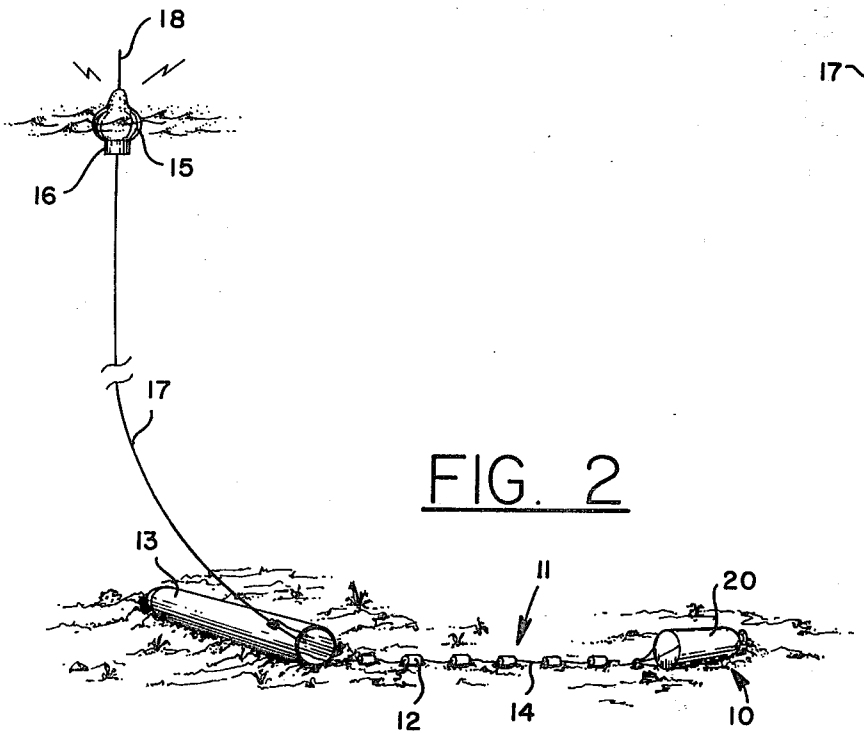
FIG. 2 illustrates a linear array fully deployed on the ocean floor.

Deep ocean currents will carry the float away from the anchoring canister as the float descends, thus trailing the hydrophones into a linear horizontal array as shown in FIG. 2. The diameter of the neck 22 can be selected to produce a suitable time for the float to settle on the ocean floor. For example, in deep oceans which have a very low current, it is necessary to reduce the buoyancy very slowly, such as over 15 to 30 minutes. Too high a sinking rate will not keep the array cable 14 taut, with the result that the array may be crooked. Too low a sinking rate is not desireable either because it increases the risk that changing surface currents will cause the mooring cable 17 to become entangled with the array cable 14.

Experience has shown that a volume of spheres tend to clump and clog the neck of the container as surface tension of the water entering the container and attempting to set the spheres hold bunches of spheres together. Therefore, to assure free flow of spheres through the neck of the container, all spheres are coated with a wetting agent to facilitate the process of water wetting the spheres. Once the spheres are completely wet they will flow easily. To accomplish that, the spheres may be mixed into a liquid slurry of alcohol or detergent as a wetting agent. To keep the slurry from running out of the plastic container, the bottom of the container may be closed by a plate with holes. The holes are then closed by water soluble plugs, such as polyvinyl alcohol plugs. The neck of the container may be similarly closed with a cap of polyvinyl alcohol.

Figures 3, 4, 5A, 5B, 5C:
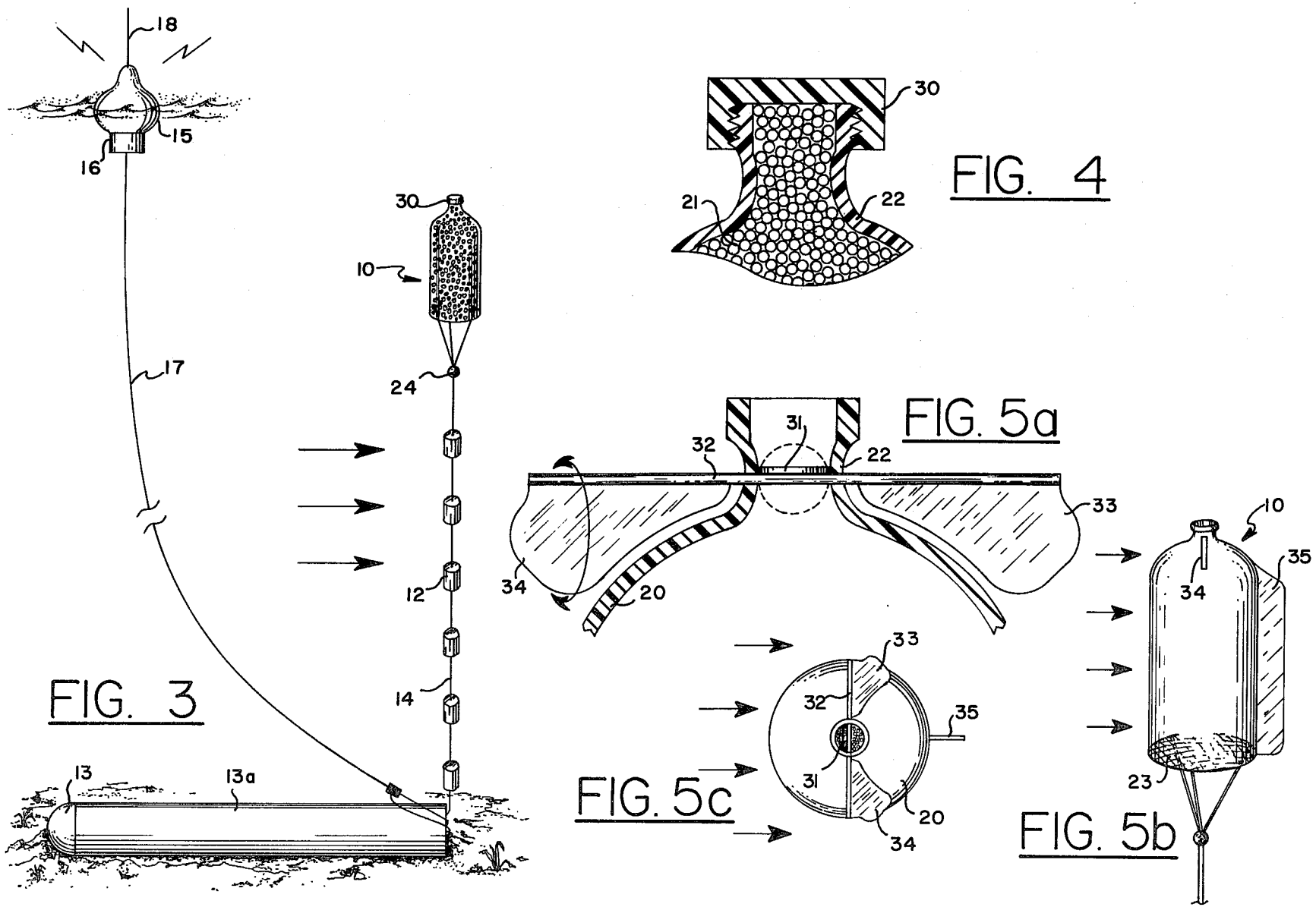
FIG. 3 illustrates a vertical array fully deployed for a period before a passage on the neck of plastic float container is opened to effect a horizontal array on the ocean floor.
FIG. 4 illustrates the manner in which a soluble cap seals the container of FIG. 3 for a period of time.

In some applications, it may be desirable to have the vertically linear erect array operate for some period, as shown in FIG. 3, before it is transformed into a horizontal linear array. That may be accomplished by capping the neck 22 of the canister with a water soluble cap 30 more clearly shown in FIG. 4. Once the cap dissolves, the microspheres will begin to flow out to transform the vertical array to a horizontal array. In ocean regions where a vertical array has advantages over the horizontal array, the cap may be substituted with one made of nonsoluble plastic, thus keeping the vertical array permanently erect.

If a horizontal linear array is desired, but the current near the ocean floor is expected to be too low to properly trail the hydrophones, it may be necessary to keep the neck of the canister closed until there is an increased current. That is accomplished by a simple vane actuated butterfly valve 31 shown in FIG. 5*a* comprised of a thin rod 32 through the center of the neck. Vanes 33 and 34 extend downwardly while the valve maintains a horizontal position to hold the hollow glass spheres in the container. A fin 35 on the side of the container, as shown in FIGS. 5*b* and 5*c*, orients the container in ocean current so that the current will be normal to the vanes. The ocean current may then open the butterfly valve by pivoting the vanes 33, 34 on the rod 32 to a horizontal position as shown in the plan view of FIG. 5*c*. The butterfly valve will then be in the dotted-line position shown in FIG. 5*a*.

Although particular embodiments of the invention have been described and illustrated herein, it is recognized that modifications and equivalents may readily occur to those skilled in the art. For example, although a wetting agent will greatly reduce the tendancy of microspheres to clump and clog the neck, an aluminum screen may be provided ahead of the bottle neck as a further measure to prevent clogging. The mesh of the screen may be selected of such size as to freely pass individual microspheres, but small enough to block clumps that may clog the neck. Another variant may be the use of comminuted particles of buoyant material, such as polyethylene or polypropylene, with a wetting agent. The term microspheres as used hereinafter is therefore intended to include such comminuted particles. Particle sizes of about 0.0001 to 0.01 inch would be suitable with an appropriately sized neck of about 5/16 inch or less, depending on the sink rate desired. Consequently it is intended that the claims be interpreted to cover such modifications and equivalents.

The embodiments of the invention in which an exclusive property or privilege is claimed are described as follows:

1. A method for deploying a linear sensor array on the ocean floor comprising the steps of deploying a vertical array on a cable between an anchor and a float, and gradually decreasing the buoyancy of the float as the float is carried away from the anchor by ocean currents.

2. A method as defined in claim 1 wherein buoyancy is provided by a buoyant material in a container, and the buoyant material is allowed to escape through a narrow passage while ocean water is allowed to flow into the container to displace the buoyant material.

3. A method as defined in claim 2 wherein said escape passage is initially closed and is maintained in the closed condition for a period of time sufficient for the array to be deployed in a vertical position over the anchor and then opened to allow the float to trail the array as ocean currents carry the float away from the anchor and the float is allowed to sink.

4. A method as defined in claim 3 wherein said escape passage is closed by a water soluble cap whereby the passage remains closed for a predetermined period required for the cap to dissolve.

5. A method as defined in claim 3 wherein said escape passage is closed by a current operated value, whereby the valve is opened by ocean current, thus assuring that the float is not allowed to sink until there is an ocean current sufficient to carry the float away from the anchor.

6. Apparatus for deploying a horizontal linear sensor array comprising an anchoring body and a buoyant body for deploying said linear sensor array in a vertical position, and means for permitting said buoyant body to gradually decrease buoyancy, whereby as said buoyant body is carried away from said anchor by ocean current, said array is deposited on the ocean floor as a horizontal array.

7. Apparatus as defined in claim 6 wherein said buoyant body is comprised of a container having a neck at the top end and a passage for ocean water at the bottom end connected to said array, and buoyant material freely floating inside said container, whereby said buoyant material flows out through said neck as ocean water enters said container.

8. Apparatus as defined in claim 7 wherein said buoyant material is comprised of microspheres.

9. Apparatus as defined in claims 8 wherein said microspheres are coated with a wetting agent to assure free flow as ocean water fills said container.

10. Apparatus for deploying a linear sensor array on the ocean floor using anchor means and a float comprising means for deploying a vertical array between said anchor means and said float, and means for gradually decreasing the buoyancy of said float as said float is carried away from said anchor means.

11. Apparatus as defined in claim 10 wherein said float is comprised of a container having a narrow neck at the top and a passage for water at the bottom, and buoyant material freely floating inside said container.

12. Apparatus as defined in claim 11 wherein said buoyant material is comprised of hollow glass microspheres.

13. Apparatus as defined in claim 12 wherein said microspheres are coated with a wetting agent to assure their free flow out of the neck of said container as said container fills with ocean water.

14. Apparatus as defined in claim 12 including means for closing the neck of said float for a period of time to assure that the array is deployed vertically before horizontal deployment takes place.

15. Apparatus as defined in claim 14 wherein said closing means is comprised of a cap made of material which dissolves in ocean water at a predetermined rate.

16. Apparatus as defined in claim 14 wherein said closing means is comprised of a current actuated valve to assure that horizontal deployment does not take place until there is an ocean current over said float.

17. Apparatus as defined in claim 16 wherein said current actuated valve is comprised of a rod through the center of said neck and a butterfly valve rigidly attached to said rod, said butterfly valve being pivoted with said rod from a position normal to the neck axis to a position parallel to the neck axis, and at least one vane outside of the neck rigidly attached to said rod in a plane normal to said butterfly valve, whereby current against said vane pivots said rod and butterfly valve as said vane is pivoted from a position parallel to the neck axis to a position normal to the neck axis while said float is maintained in an upright position.

18. Apparatus as defined in claim 17 including a fin rigidly attached to said float in a plane parallel to the axis of said neck and normal to the axis of said rod, whereby an ocean current orients said float for said current to act on said vane.

* * * * *